US008361383B2

(12) United States Patent
Hayashi et al.

(10) Patent No.: US 8,361,383 B2
(45) Date of Patent: Jan. 29, 2013

(54) ALLERGEN REDUCTION-PROCESSING AGENT FOR FIBROUS PRODUCT

(75) Inventors: Rie Hayashi, Saitama (JP); Masato Ishibashi, Saitama (JP); Kohei Ohara, Shiga (JP); Takayuki Oishi, Shiga (JP); Eiken Kuzutani, Shiga (JP); Yumiko Hikida, Shiga (JP)

(73) Assignees: Honda Motor Co., Ltd., Tokyo (JP); T.B. Kawashima Co., Ltd., Aichi (JP)

( * ) Notice: Subject to any disclaimer, the term of this patent is extended or adjusted under 35 U.S.C. 154(b) by 0 days.

(21) Appl. No.: 13/094,094

(22) Filed: Apr. 26, 2011

(65) Prior Publication Data

US 2011/0269886 A1 Nov. 3, 2011

(30) Foreign Application Priority Data

Apr. 30, 2010 (JP) ..... 2010-105453
Mar. 8, 2011 (JP) ..... 2011-049822

(51) Int. Cl.

| | |
|---|---|
| ***B32B 5/02*** | (2006.01) |
| ***B32B 27/04*** | (2006.01) |
| ***B32B 27/12*** | (2006.01) |
| ***C22C 23/06*** | (2006.01) |
| ***D06M 13/224*** | (2006.01) |
| ***D06M 15/53*** | (2006.01) |
| ***D06M 23/06*** | (2006.01) |

(52) U.S. Cl. ..... 420/406; 442/123; 252/8.81; 252/8.91

(58) Field of Classification Search ..... None
See application file for complete search history.

(56) References Cited

U.S. PATENT DOCUMENTS 4,233,347 A * 11/1980 Lim et al. ..... 427/352
4,269,913 A * 5/1981 Lim et al. ..... 429/251

FOREIGN PATENT DOCUMENTS

| | | |
|---|---|---|
| JP | 2004-290922 | 10/2004 |
| JP | 2006-057212 | 2/2006 |
| JP | 2009-013543 | 1/2009 |
| WO | 2009044648 | 4/2009 |
| WO | 2009078449 | 6/2009 |

* cited by examiner

*Primary Examiner* — Nora Rooney
(74) *Attorney, Agent, or Firm* — Kirschstein, et al.

(57) ABSTRACT

Provided is an allergen reduction-processing agent capable of giving an allergen reducing effect to a fibrous product while restraining whitening, and chalk marks. As chemical agents having an allergen-restraining effect, a zirconium based compound and a sulfonyl group-containing aromatic compound are used. An aqueous dispersion containing these components is used as an allergen reduction-processing agent for processing a fibrous product. The ratio by weight of the zirconium based compound to the aromatic compound is preferably 1 to 6:0.05 to 1.5.

6 Claims, No Drawings

ALLERGEN REDUCTION-PROCESSING AGENT FOR FIBROUS PRODUCT

BACKGROUND OF THE INVENTION (1) Field of the Invention

The present invention relates to an allergen reduction-processing agent for giving an effect of inactivating an allergen resulting from ticks, or pollens of a (Japanese) cedar, a hinoki, hogweed, or some other to a fibrous product such as a cloth while restraining whitening, chalk marks, water spots (water stains), and others.

(2) Description of Related Art

As a processing agent having an effect of inactivating an allergen resulting from ticks, or pollens of a cedar, a hinoki or some other, known are (1) anti-allergen agents produced from natural components such as catechin (extract of a shrimp, or tea), an olive extract, a coffee bean extract, a herb extract, and others; (2) inorganic anti-allergen agents of calcium, aluminum, zinc, zirconium, lanthanum, and other types; and (3) organic anti-allergen agents of polyphenol, amino acid, phthalocyanine and other types.

However, when any one of these anti-allergen agents is applied, as it is, onto a surface of a cloth, whitening, chalk marks, or water spots (stains of a kind) may be generated. It is therefore difficult to apply the agent onto a cloth dyed into a dark color. Thus, in order to solve such a problem, it is supposed that an acrylic resin, a urethane resin or some other resin is used to fix the agent to the resin. However, in accordance with the amount or the types of an agent for emulsifying or dispersing the resin, there may be caused a problem that the flame retardancy is inhibited, or in reverse, whitening and chalkmarks, or water spots are easily generated.

For example, Japanese Patent Laid-open Publication No. 2009-13543 and Japanese Patent Laid-open Publication No. 2006-57212, and others disclose the use of zirconium oxide as a fiber processing agent for restraining the generation of an allergy caused by pollens. However, zirconium oxide does not easily give a sufficient anti-allergy property against a tick allergy, and further does easily cause whitening, water spots or some other problem against processed cloths. Furthermore, as an anti-allergen agent for adsorbing and collecting allergen materials such as ticks or pollens, Japanese Patent Laid-open Publication No. 2004-290922 discloses a water-insoluble polymer having a phenolic hydroxyl group, which is poly-4-vinylphenol. However, the use thereof gives a problem about a discoloration based on heat and light, or about some other.

SUMMARY OF THE INVENTION

An object of the present invention is to solve such problems and to provide a processing agent for giving an effect of sufficiently inactivating an allergen resulting from ticks, or pollens of a cedar, a hinoki, hogweed, or some other to a fibrous product such as a cloth while restraining whitening, chalk marks, water spots and others.

In the present invention, a zirconium based compound and an aromatic compound having a sulfonyl group (sulfonyl group-containing aromatic compound), the compounds having an allergen-restraining effect, are used together with each other, thereby making it possible to attain the desired object. Here, the allergen reduction-processing agent of the present invention is an aqueous dispersion containing both of a zirconium based compound and a sulfonyl group-containing aromatic compound, the compounds having an allergen-restraining effect.

In the present invention, the zirconium based compound may be any zirconium based compound that is generally known as an allergen restraining agent. Examples thereof include zirconium oxide, zirconium phosphate, zirconium sulfate, zirconium hydroxide, zirconium hydrochloride, zirconium oxychloride, zirconium nitrate, and zirconium acetate. Zirconium oxide or zirconium phosphate is preferred. Zirconium phosphate is particularly preferred.

The sulfonyl group-containing aromatic compound may be any one of polysulfone, polyethersulfone, polyallylsulfone polyphenylsulfone, and polymers containing an aromatic sulfonium salt.

The zirconium based compound and the sulfonyl group-containing aromatic compound are each preferably in a granular form. For example, it is preferred to prepare an aqueous paste or aqueous dispersion with a granular product having an average particle diameter of 0.3 μm to 2.0 μm. If the average particle diameter is less than 0.3 μm, the particles re-aggregate so that a stable paste or dispersion is not easily prepared. If the average particle diameter is more than 2.0 μm, a processing agent capable of effectively restraining whitening is not easily obtained. The average particle diameter can be measured by use of a scattering type particle size distribution measuring device (for example, a scattering type particle size distribution measuring device, LA-950, manufacture by Horiba, Ltd.).

It is preferred that at the time of the preparation of the aqueous paste or aqueous dispersion, a resin (binder) is added thereto so as to allow the processing agent to easily adhere to a fibrous product. This resin may be any ordinary processing resin such as acrylic resin, urethane resin, or polyester resin. In the processing of products made of synthetic fiber having thermal meltability, such as polyester fiber, polyester resin is preferred in order that the product can keep an appropriate flame retardancy. It is particularly preferred to use a water-soluble or a water-dispersible polyester resin, for example, a polyester resin containing in the molecular thereof a hydrophilic component such as polyethylene glycol, a carboxyl group, carbonyl group, a carboxylate, a sulfonate, a sulfate ester salt, or a phosphate ester salt. From the viewpoint of processability, it is preferred to use, as a dispersing agent for the polyester resin, n-propylcellosolve (boiling point: 150° C.), i-propylcellosolve (boiling point: 142° C.), or t-butylcellosolve (boiling point: 151° C.). n-butylcellosolve (boiling point: 171° C.) may be used together with n-propyl alcohol (boiling point: 97° C.). When the weight of the polyester resin is regarded as 1, it is preferred to use the dispersing agent for the polyester resin preferably in a weight of 0.1 to 1.5, more preferably in a weight of about 0.2 to 1.2.

About the ratio between the amounts of the zirconium based compound and the sulfonyl group-containing aromatic compound, the ratio by weight of the former to the latter is preferably about 1 to 6:0.05 to 1.5. It is advisable that the processing agent of the present invention is applied to a fibrous product by padding, dipping, coating, or some other method, and heating and drying the resultant. In the case of the dipping treatment, the content by weight of the total of the zirconium based compound and the sulfonyl group-containing aromatic compound in the processing agent (aqueous dispersion) is preferably from about 0.4% to 5.5% by weight, more preferably from about 1% to 5% by weight, in particular preferably from about 1.5% to 4% by weight. The content by weight of the resin in the processing agent is preferably from about 0.1% to 3% by weight. These concentrations are ones when processing with the processing agent is actually conducted (i.e., final concentrations). For the processing agent, it is allowable to produce the agent in a concentrated state, and dilute the concentrated agent to give the aforementioned concentrations when the agent is used. For example, it is allowable to produce a concentrated liquid having a concentration of about 2 to 70 times larger than the aforementioned concentrations, and dilute the liquid about 2 to 70 times with water when the liquid is used.

The processing agent of the present invention can effectively prevent whitening, water spots and others, for example, by subjecting a cloth to dipping treatment and drying the resultant at 170° C. or lower, in particular, 150° C. or lower. Additionally, the agent can give the cloth a very good effect for anti-tick-allergen property and anti-pollen-allergen property.

In the processed cloth, the ratio of the adhesive amount of the zirconium based compound to that of the sulfonyl group-containing aromatic compound is preferably from about 1 $g/m^2$ to 6 $g/m^2$:0.05 $g/m^2$ to 1.5 $g/m^2$. The adhesive amount of the resin is preferably from about 0.3 $g/m^2$ to 3 $g/m^2$, more preferably from about 1 $g/m^2$ to 3 $g/m^2$.

DETAILED DESCRIPTION OF PREFERRED EMBODIMENTS

Next, the present invention will be more specifically described by way of examples, however, the present invention is not limited to the examples.

Measuring methods for performance-evaluation in the examples are as follows:

<Allergen Inactivity Ratio Measuring Method>

Method A: Anti-Allergen Agent Performance Evaluating Method (Ticks or a Cedar)

To 1 ml of a suspension of tick or cedar pollen allergen is dropwise added 150 μl of each evaluating sample (10% dispersed product in water). After one hour, the pH thereof is adjusted to neutrality, and the resultant liquid is used as an evaluating liquid. The amount of the ticks or cedar pollen allergens in the liquid is measured by the ELISA method. The amount is compared with the amount of allergens in distilled water plus the allergen suspension, so as to calculate the allergen reduction ratio.

The described tick allergen amount denotes the total protein amount converted from the amount of DerfII. The cedar pollen allergen amount denotes the amount of CryjI.

*: (allergen amount in suspension+distilled water−allergen amount in evaluating liquid)/(allergen amount in suspension+distilled water)×100

*: initial allergen amount: ticks=about 370 ng, or cedar pollens=about 10 ng

Method B: Anti-Allergen Processed Product Inactivity Ratio Measuring Method (Hogweed)

Each evaluating sample (cloth), 5 cm×5 cm in size, is charged into a test tube. Thereto is dropwise added 1.0 ml of a liquid in which the amount of hogweed allergens is adjusted to 70 ng/ml. Then the test tube is cured at a temperature of 37° C. for 24 hours. The allergen amount in the liquid is measured by the ELISA method. From the allergen amount measured after the curing, a calculation is made about the allergen amount reduced from the amount of the charged allergens. Therefrom, the inactivation ratio is calculated.

Method C: Anti-Allergen Processed Product Inactivity Ratio Measuring Method (Ticks or a Cedar)

Each evaluating sample (cloth), 5 cm×2.5 cm in size, is charged into a test tube. Thereto is dropwise added 2.25 ml of a liquid in which the amount of tick allergens is adjusted to 47 ng/ml or that of cedar allergens is adjusted to 6.7 ng/ml, respectively. Then the test cube is cured for 17 hours. The allergen amount in the liquid is measured by the ELISA method. From the allergen amount measured after the curing, a calculation is made about the allergen amount reduced from the amount of the charged allergens. Therefrom, the inactivation ratio is calculated.

The tick allergen amount denotes the total protein amount converted from the amount of DerfII. The cedar pollen allergen amount denotes the amount of CryjI.

Method D: Anti-Allergen Processed Product Inactivity Ratio Measuring Method (Hinoki)

Each evaluating sample (cloth), 5 cm×4 cm in size, and ion exchange water are put into a polyethylene container, and the sample is washed by vibrating the container at 27° C. for 2 hours. Thereafter, the evaluating sample is dried at 50° C. one night, and then is charged into a test tube. Thereto is dropwise added 1.0 ml of a liquid in which the amount of hinoki pollens is adjusted to 10 mg/ml. They are then brought into contact with each other for 1 hour. The pollens are centrifuged by centrifugation, and the supernatant is measured by the ELISA method. From the allergen amount measured after the curing, a calculation is made about the allergen amount reduced from the amount of the charged allergens. Therefrom, the inactivation ratio is calculated.

As the amount of the charged allergens, the allergen amount contained in the charged hinoki pollens that is separately measured is used.

<Flammability Performance>

In accordance with a test of flammability of interior materials (JIS D 1201 or ISO 3795), a case with burning rate of 80 mm/minute or less is judged to be good.

<Water Spot Test>

(I) To the front surface of a processed cloth is dropwise added 5 ml of purified water, and the cloth is naturally dried for 24 hours. Thereafter, the result as to whether or not water spots (color change) are generated is ranked.

(II) To the front surface of a processed cloth is dropwise added 5 ml of hot water of 95° C. temperature. At each of the initial time and the time after 3 minutes, the result as to whether or not water spots (color change) are generated is ranked.

Judgment: Detail

Class 5: Color change is not generated at all.

Class 4: Color change is hardly recognized.

Class 3: Slight color change is recognized.

Class 2: Color change is easily recognized.

Class 1: Color change is remarkable.

<Whitening Check Test>

A polyester cloth dyed into black (blank) is used to rank each sample subjected to anti-allergen processing in accordance with a recipe about a color change (toward whiteness) from the color of the blank.

Judgment: Detail

Class 5: Color change is not generated at all.

Class 4: Color change is hardly recognized.

Class 3: Slight color change is recognized.

Class 2: Color change is easily recognized.

Class 1: Color change is remarkable.

<Chalk Mark Check Test>

A polyester cloth dyed into black (blank) is used to rank each sample subjected to anti-allergen processing in accordance with a recipe about the degree of whitening based on scratches generated by scraping the front surface of the sample lightly with a nail.

Judgment: Detail

Class 5: Color change is not generated at all.

Class 4: Color change is hardly recognized.

Class 3: Slight color change is recognized.

Class 2: Color change is easily recognized.

Class 1: Color change is remarkable.

<Discoloration Based on Heat>

Each sample is thermally treated at 80° C. for 200 hours. A discoloration thereof is checked.

<Discoloration Based on Light>

Each sample is evaluated on the basis of xenon 80MJ.

Example 1

Selection of an Anti-Allergen Agent (1) Into water was incorporated 1.5 g of each chemical agent shown in Table 1 to prepare 1000 ml of an aqueous dispersion. A case with the chemical agent being completely dissolved in water was estimated to be poor in anti-water-solubility.

(2) A polyester knit piece having an A3 size (proportion of the polyester: 100%, weight per unit area: 360 g/m$^2$) was immersed in an aqueous dispersion of any agent that was not easily dissolved in water (anti-water-solubility: acceptable), out of the chemical agents, or an aqueous dispersion of any agent that was not dissolved in water (anti-water-solubility: good), out of them. Next, the piece was wrung (wring ratio: 65%) with a mangle at a pressure of 3.0 kgf/cm$^2$ between its rolls, and then dried at 150° C. for 3 minutes.

Some of chemical agents in which the anti-water-solubility was poor, out of all the chemical agents, were subjected to the same treatment as described above.

(3) The thus-obtained processed cloths were each measured about the tick allergen amount and the cedar pollen allergen amount [according to the method A (anti-allergen agent performance evaluating method)], the discoloration based on heat, and the discoloration based on light.

These test results are shown in Table 1.

The sulfonyl group-containing aromatic compound used in each of the examples was a polymer containing an aromatic sulfonium salt (SSPA-WN, manufactured by Sekisui Chemical Co., Ltd.

TABLE 1

| | Type | Chemical agent | Anti-tick-allergen property (%) by method A | Anti-cedar-pollen-allergen property (%) by method A | Anti-water-solubility | discoloration based on heat | discoloration based on light | Total evaluation |
|---|---|---|---|---|---|---|---|---|
| 1 | Calcium type | Calcium chloride | 56 | 21 | poor | good | good | poor |
| 2 | Aluminum type | Potassium-aluminum alum | — | — | poor | — | — | poor |
| 3 | Zirconium type | Basic zirconium | — | — | poor | — | — | poor |
| | | Basic zirconyl chloride | 95 | 94 | poor | poor | poor | poor |
| | | Zirconium sulfate | — | — | poor | — | — | poor |
| | | Zirconyl carbonate | 56 | 66 | poor-acceptable | poor | poor | poor |
| | | Zirconium phosphate | 96 | 92 | good | good | good | good |
| 4 | Lanthanum type | Lanthanum chloride | 65 | 73 | acceptable-good | good | good | acceptable |
| 5 | Aromatic compound | Polyvinyl phenol | 95 | 92 | good | poor | poor | poor |
| | | Sulfonyl group-containing aromatic compound | 96 | 94 | good | good | good | good |
| 6 | Others | Cetylpyridinium chloride | 93 | 94 | poor | good | good | poor |
| | | Betaine alkyldimethylaminoacetate | — | — | poor | — | — | poor |

Example 2

As shown in Table 2 (the unit of each numerical value therein: % by weight), while the types and the amount of a resin were varied, α-zirconium phosphate and the sulfonyl group-containing aromatic compound were used together with each other to produce aqueous dispersions, the amount of each of which was 1000 ml. A polyester knit piece having an A3 size (proportion of the polyester: 100%, weight per unit area: 400 g/m$^2$) was immersed in each of these dispersions. Next, the piece was wrung (wring ratio: 64%) with a mangle at a pressure of 3.0 kgf/cm$^2$ between its rolls, and then dried at 150° C. for 3 minutes.

In Table 2 are shown the compatibility of each of the resin mixed liquids, and the whitening resistance, the texture, and the flammability of each of the processed cloths. About the whitening resistance, any case with the result based on the aforementioned ranking into the five classes being any one from classes 3 to 5 was estimated to be good.

TABLE 2

| No. | Chemical agent name | | I | II | III | IV |
|---|---|---|---|---|---|---|
| 1 | Zirconium phosphate | | 2.3 | 2.3 | 2.3 | 2.3 |
| 2 | Sulfonyl group-containing aromatic compound | | 0.6 | 0.6 | 0.6 | 0.6 |
| 3 | Urethane resin | | | 2 | | |
| 4 | Acrylic resin | | | | 2 | |
| 5 | Polyester resin | Main component (polyester resin) | | | | 0.5 |
| | | Dispersing agent (t-butyl-cellosolve) (boiling point: 151° C.) | | | | 0.5 |
| | | Others | | | | 1.0 |
| 6 | Dispersing agent, water, and others | | 97.1 | 95.1 | 95.1 | 95.1 |
| Compatibility | | | good | good | good | good |
| Whitening resistance | | | poor | poor | good | good |
| Texture | | | good | acceptable | acceptable | good |

TABLE 2-continued

| No. | Chemical agent name | I | II | III | IV |
|---|---|---|---|---|---|
| Flammability | | good | poor | poor | good |
| Total evaluation | | poor | poor | poor | good |

The chemical agents shown in Table 2 are as follows:

Zirconium phosphate: AlleRemove ZK manufactured by Toagosei Co., Ltd.

Sulfonyl group-containing aromatic compound: SSPA, manufactured by Sekisui Chemical Co., Ltd.

Urethane resin: EVAPHANOL HA, manufactured by Nicca Chemical Co., Ltd.

Acrylic resin: NEWCOAT FH, manufactured by Shin-Nakamura Chemical Co., Ltd.

Polyester resin: PLUSCOAT Z, manufactured by Goo Chemical Co., Ltd.

Example 3

As shown in Table 3, the types of a dispersing agent used together with the polyester resin was changed to process polyester knit pieces in the same way as in IV in Example 2.

The method of the water spot test (II) for any processed cloth was carried out. The results are shown in Table 3 (any sample with the aforementioned ranking result being Class 3 to 5, Class 2 or Class 1 was estimated to be good, acceptable or poor, respectively).

TABLE 3

| | | | Comparative Examples | | | | | Examples | | | |
|---|---|---|---|---|---|---|---|---|---|---|---|
| No. | | Contents | 1 | 2 | 3 | 4 | 5 | 1 | 2 | 3 | 4 |
| 1 | Main component | Polyester resin | 24 | 20 | 25 | 25 | 25 | 25 | 25 | 25 | 25 |
| 2 | Dispersing agents (organic solvent type) | nMP: n-methylpyrrolidone (boiling point: 204° C.) | 6 | | | | | | | | |
| 3 | | nBC: n-butylcellosolve (boiling point: 171° C.) | | 10 | 25 | 15 | 10 | 5 | | | |
| 4 | | nPC: n-propylcellosolve (boiling point: 150° C.) | | | | | | | 25 | | |
| 5 | | tBC: t-butylcellosolve (boiling point: 151° C.) | | | | | | | | 10 | |
| 6 | | IPC: i-propylcellosolve (boiling point: 142° C.) | | | | | | | | | 25 |
| 7 | | n-Propanol (boiling point: 97° C.) | | | | 5 | 10 | 20 | | | |
| 8 | Water and others | | 70 | 70 | 50 | 55 | 55 | 50 | 50 | 65 | 50 |
| Total | | | 100 | 100 | 100 | 100 | 100 | 100 | 100 | 100 | 100 |
| water spot test results | | Initial | poor | acceptable | poor | poor | acceptable | good | good | good | good |
| Sample processing: dipping-nipping, drying treatment for 150° C. for 3 minutes, and dropwise addition of 5 ml of hot water of 95° C. temperature, followed by evaluation of water spots and whitening | | After 3 minutes | poor | acceptable | poor | poor | acceptable | good | good | good | good |
| Total evaluation | | | poor | poor | poor | poor | poor | good | good | good | good |

Example 4

As shown in Table 4, the ratio between α-zirconium phosphate and the sulfonyl group-containing aromatic compound used together with each other was changed to prepare aqueous dispersions, the volume of each of which was 1000 ml. The polyester resin used therein was the same as in Example 1 in Table 3. A polyester knit piece having an A3 size (proportion of the polyester: 100%, weight per unit area: 360 g/m$^2$) was immersed in each of these dispersions. Next, the piece was wrung (wring ratio: 65%) with a mangle at a pressure of 3.0 kgf/cm$^2$ between its rolls, and then dried at 150° C. for 3 minutes.

Each of the processed cloths was measured about water spot resistance, whitening resistance, chalk mark resistance, flammability, anti-tick-allergen property, and anti-cedar-pollen-allergen property. The cloth was totally evaluated (good; acceptable; and poor). The results are shown in Table 4. The water spot test was made according to the method I.

In Table 4, the amount of each of zirconium phosphate, the sulfonyl group-containing aromatic compound, and the polyester resin is an adhesive amount (g/m$^2$) onto the concerned processed cloth. Each of the used processing agents (aqueous dispersions) was one having a concentration obtained by making a conversion in accordance with the following equation: adhesive amount of 1 g/m$^2$=0.426% by weight.

TABLE 4

| No. | Zirconium phosphate ($g/m^2$) | Sulfonyl-group-having aromatic compound ($g/m^2$) | Polyester resin ($g/m^2$) | water spot resistance water (classes) | | Whitening resistance (classes) | | Chalk mark resistance (classes) | | Flammability | | | | Anti-tick-allergen property by method C (%) | Anti-cedar-pollen-allergen property by method C (%) | Total evaluation |
|---|---|---|---|---|---|---|---|---|---|---|---|---|---|---|---|---|
| | | | | | | | | | | Distance (mm) | Period (seconds) | Burning rate (min/min) | Flammability | | | |
| | | | | Class 5 good<br>Class 4 good<br>Class 3 good<br>Class 2 acceptable<br>Class 1 poor | | Class 5 good<br>Class 4 good<br>Class 3 good<br>Class 2 poor<br>Class 1 very poor | | Class 5 good<br>Class 4 good<br>Class 3 good<br>Class 2 poor<br>Class 1 very poor | | Self-extinguishing<br>100 mm/minorless<br>101 mm/minormore | | very good<br>good<br>poor | | 90% or more good | 90% or more good | (good, acceptable, poor) |
| 1 | 9.0 | 0.0 | 1.1 | 1 | poor | 1 | very poor | 1 | very poor | 16 | 5 | Self-extinguishing property | very good | 99 | 100 | poor |
| 2 | 15.0 | | | 1 | poor | 1 | very poor | 1 | very poor | 19 | 15 | Self-extinguishing property | very good | 99 | 100 | poor |
| 3 | 1.0 | 0.05 | | 4 | good | 4 | good | 4 | good | 14 | 9 | Self-extinguishing property | very good | 94 | 99 | good |
| 4 | 3.0 | | | 2 | acceptable | 4 | good | 4 | good | 18 | 11 | Self-extinguishing property | very good | 97 | 99 | acceptable |
| 5 | 6.0 | | | 2 | acceptable | 3 | good | 3 | good | 10 | 4 | Self-extinguishing property | very good | 98 | 99 | acceptable |
| 6 | 9.0 | | | 1 | poor | 1 | very poor | 1 | very poor | 85 | 83 | 61 | good | 99 | 99 | poor |
| 7 | 15.0 | | | 1 | poor | 1 | very poor | 1 | very poor | 113 | 105 | 65 | good | 99 | 99 | poor |
| 8 | 1.0 | 0.15 | | 4 | good | 5 | good | 4 | good | 28 | 25 | Self-extinguishing property | very good | 95 | 96 | good |
| 9 | 6.0 | | | 3 | good | 3 | good | 3 | good | 21 | 32 | Self-extinguishing property | very good | 98 | 99 | good |
| 10 | 15.0 | | | 1 | poor | 1 | very poor | 1 | very poor | 26 | 16 | Self-extinguishing property | very good | 100 | 99 | poor |
| 11 | 6.0 | 0.3 | | 3 | good | 4 | good | 3 | good | 36 | 27 | Self-extinguishing property | very good | 97 | 99 | good |
| 12 | 9.0 | | | 2 | acceptable | 2 | poor | 2 | poor | 74 | 60 | 74 | good | 99 | 99 | poor |
| 13 | 15.0 | | | 1 | poor | 1 | very poor | 1 | very poor | 57 | 49 | 70 | good | 99 | 99 | poor |
| 14 | 0.0 | 0.5 | | 5 | good | 5 | good | 5 | good | 27 | 22 | Self-extinguishing property | very good | 46 | 87 | poor |
| 15 | 1.0 | | | 5 | good | 5 | good | 5 | good | 41 | 35 | Self-extinguishing property | very good | 97 | 97 | good |
| 16 | 6.0 | | | 4 | good | 4 | good | 4 | good | 57 | 54 | 63 | good | 94 | 99 | good |
| 17 | 15.0 | | | 1 | poor | 1 | very poor | 1 | very poor | 68 | 62 | 66 | good | 100 | 99 | poor |
| 18 | 0.0 | 1.0 | | 5 | good | 5 | good | 5 | good | 34 | 20 | Self-extinguishing property | very good | 46 | 91 | poor |
| 19 | 1.0 | | | 5 | good | 5 | good | 5 | good | 45 | 16 | Self-extinguishing property | very good | 90 | 95 | good |
| 20 | 3.0 | | | 5 | good | 5 | good | 5 | good | 81 | 71 | 68 | good | 92 | 99 | good |

TABLE 4-continued

| No. | Zirconium phosphate ($g/m^2$) | Sulfonyl-group-having aromatic compound ($g/m^2$) | Polyester resin ($g/m^2$) | water spot resistance water (classes) | | Whitening resistance (classes) | | Chalk mark resistance (classes) | | Flammability | | | | Anti-tick-allergen property by method C (%) | Anti-cedar-pollen-allergen property by method C (%) | Total evaluation |
|---|---|---|---|---|---|---|---|---|---|---|---|---|---|---|---|---|
| | | | | | | | | | | Distance (mm) | Period (seconds) | Burning rate (min/min) | Flammability | | | |
| 21 | 6.0 | | | 4 | good | 4 | good | 4 | good | 87 | 79 | 66 | good | 92 | 99 | good |
| 22 | 9.0 | | | 2 | acceptable | 2 | poor | 2 | poor | 106 | 86 | 74 | good | 96 | 99 | poor |
| 23 | 15.0 | | | 1 | poor | 1 | very poor | 1 | very poor | 126 | 97 | 78 | good | 99 | 99 | poor |
| 24 | 0.0 | 1.5 | | 5 | good | 5 | good | 5 | good | 45 | 45 | Self-extinguishing property | very good | 30 | 70 | poor |
| 25 | 1.0 | | | 5 | good | 5 | good | 5 | good | 83 | 67 | 74 | good | 90 | 95 | good |
| 26 | 3.0 | | | 5 | good | 5 | good | 5 | good | 112 | 88 | 76 | good | 92 | 99 | good |
| 27 | 6.0 | | | 3 | good | 4 | good | 4 | good | 104 | 94 | 66 | good | 96 | 99 | good |
| 28 | 9.0 | | | 3 | good | 2 | poor | 2 | poor | 125 | 98 | 77 | good | 93 | 99 | poor |
| 29 | 15.0 | | | 1 | poor | 1 | very poor | 1 | very poor | 167 | 127 | 79 | good | 98 | 99 | poor |

As shown in Table 4, in Nos. 3 to 5, 8 to 9, 11, 15 to 16, 19 to 21 and 25 to 27, in which the ratio of zirconium phosphate to the sulfonyl group-containing aromatic compound, they being used together with each other, was 1.0 to 6.0:0.05 to 1.5, practicable anti-allergen agents were obtained.

On the other hand, in cases where the sulfonyl group-containing aromatic compound was used in a large amount but no zirconium phosphate was used (Nos. 18 and 24), good results were obtained about all of water spot resistance, whitening resistance, chalk mark resistance, and flammability, however, the anti-tick-allergen property was very poor so that practical results were unable to be obtained because the concerned chemical agent was covered with the resin (binder) used together.

In reverse, when zirconium phosphate was used, the anti-tick-allergen property was very good, however, in cases where no sulfonyl group-containing aromatic compound was used (Nos. 1 and 2), water spots, whitening and chalk marks were unable to be avoided.

Example 5

As shown in Table 5, α-zirconium phosphate, the sulfonyl group-containing aromatic compound and a polyester resin were used together with each other to produce aqueous dispersions, the amount of each of which was 1000 ml. The used polyester resin was the same as used in Example 3 in Table 3. A polyester knit piece having an A3 size (proportion of the polyester: 100%, weight per unit area: 360 g/m$^2$) was immersed in each of these dispersions. Next, the piece was wrung (wring ratio: 65%) with a mangle at a pressure of 3.0 kgf/cm$^2$ between its rolls, and then dried at 150° C. for 3 minutes.

Each of the processed cloths, and unprocessed cloths (Comparative Example) were measured about anti-hogweed-allergen property (the number of the processed cloths, and that of the unprocessed cloths were each 3). The results are shown in Table 5. In the table, each of the concentrations represents the amount (unit: % by weight) in the concerned processing agent (aqueous dispersion), and each of the adhesive amounts represents the adhesive amount onto the concerned cloth.

TABLE 5

| | Zirconium phosphate | | Sulfonyl group-containing aromatic compound | | Polyester resin | | t-Butylcellosolve | | Anti-hogweed-allergen property (%) |
|---|---|---|---|---|---|---|---|---|---|
| No. | Concentration (% by weight) | Adhesive amount (g/m$^2$) | Concentration (% by weight) | Adhesive amount (g/m$^2$) | Concentration (% by weight) | Adhesive amount (g/m$^2$) | Concentration (% by weight) | Adhesive amount (g/m$^2$) | by method B 70% or more good |
| 1 | 0.0 | 0.0 | 0.0 | 0.0 | 0.0 | 0.0 | 0.0 | 0.0 | 4 |
| 2 | | | | | | | | | 1 |
| 3 | | | | | | | | | 7 |
| 4 | 2.56 | 6.0 | 0.21 | 0.5 | 0.47 | 1.1 | 0.19 | 0.0 | 99 |
| 5 | | | | | | | | | 99 |
| 6 | | | | | | | | | 100 |

As shown in Table 5, in the unprocessed cloths (Nos. 1 to 3), anti-allergen property against hogweed was hardly observed. However, in the cloths processed with the respective aqueous dispersions containing zirconium phosphate and the sulfonyl group-containing aromatic compound (Nos. 4 to 6), anti-allergen property against hogweed, which was near to an inactivation ratio of 100%, was exhibited.

This matter demonstrated that the allergen reduction-processing agent according to the present invention exhibits an excellent anti-allergen property regardless of the kind of pollens.

Example 6 s shown in Table 6, α-zirconium phosphate, the sulfonyl group-containing aromatic compound and a polyester resin were used together with each other to produce aqueous dispersions, the amount of each of which was 1000 ml. The used polyester resin was the same as used in Example 3 in Table 3. A polyester knit piece having an A3 size (proportion of the polyester: 100%, weight per unit area: 360 g/m$^2$) was immersed in each of these dispersions. Next, the piece was wrung (wring ratio: 65%) with a mangle at a pressure of 3.0 kgf/cm$^2$ between its rolls, and then dried at 150° C. for 3 minutes.

This processed cloth, and an unprocessed cloth (Comparative Example) were each measured about anti-hinoki-allergen property. The results are shown in Table 6. In the table, each of the concentrations represents the amount (unit: % by weight) in the concerned processing agent (aqueous dispersion), and each of the adhesive amounts represents the adhesive amount onto the concerned cloth.

TABLE 6

| No. | Zirconium phosphate | | Sulfonyl group-containing aromatic compound | | Polyester resin | | t-Butylcellosolve | | Anti-hinoki-allergen property (%) |
|---|---|---|---|---|---|---|---|---|---|
| | Concentration (% by weight) | Adhesive amount ($g/m^2$) | Concentration (% by weight) | Adhesive amount ($g/m^2$) | Concentration (% by weight) | Adhesive amount ($g/m^2$) | Concentration (% by weight) | Adhesive amount ($g/m^2$) | by method D 70% or more good |
| 1 | 0.0 | 0.0 | 0.0 | 0.0 | 0.0 | 0.0 | 0.0 | 0.0 | 31 |
| 2 | 2.56 | 6.0 | 0.21 | 0.5 | 0.47 | 1.1 | 0.19 | 0.0 | 79 |

As shown in Table 6, for the unprocessed cloth (No. 1), the anti-allergen property against hinoki was an inactivation ratio of about 30%, however, for the cloth processed with the aqueous dispersion containing zirconium phosphate and the sulfonyl group-containing aromatic compound (No. 2), the anti-allergen property against hinoki was an inactivation ratio close to about 80%.

This matter demonstrated that the allergen reduction-processing agent according to the present invention exhibits an excellent anti-allergen property regardless of the kind of pollens.

A fibrous product processed with the processing agent of the present invention is a product which undergoes neither water spots nor whitening, and is excellent in flame retardancy, anti-tick-allergen property, and anti-pollen-allergen property. Thus, the product can be stably used for an interior material for a car, furniture, a curtain, a mat, or an interior decorating material such as synthetic leather.

What is claimed is:

1. An agent for application to a fibrous product, the agent being an aqueous dispersion which contains:

(a) zirconium phosphate and a polymer containing an aromatic sulfonium salt, in which the ratio by weight of the former to the latter is 1 to 6:0.05 to 1.5;

(b) a polyester resin; and (c) at least one selected from the group consisting of n-butylcellosolve, t-butylcellosolve, n-propylcellosolve, and isopropyl cellosolve as a solvent for dispersing the polyester resin.

2. The agent according to claim 1, in which the zirconium phosphate and the polymer containing the aromatic sulfonium salt contained in the aqueous dispersion are each in a granular form.

3. The agent according to claim 1, in which the content of the total of the zirconium phosphate and the polymer containing the aromatic sulfonium salt in the aqueous dispersion is from about 0.4% to 5.5% by weight.

4. The agent according to claim 1, in which the content of the polyester resin in the aqueous dispersion is from about 0.1% to 3% by weight.

5. The agent according to claim 1, in which the ratio by weight of the polyester resin to the solvent is 1:0.1 to 1.5.

6. A polyester fibrous product, comprising:

zirconium phosphate, a polymer containing an aromatic sulfonium salt and a polyester resin adhering to the fibrous product; and the ratio of the zirconium phosphate to the polymer containing the aromatic sulfonium salt being 1 $g/m^2$ to 6 $g/m^2$:0.05 $g/m^2$ to 1.5 $g/m^2$.

* * * * *